United States Patent [19]

Honey et al.

[11] 3,933,604

[45] Jan. 20, 1976

[54] METHOD OF ELECTROLYTICALLY EXTRACTING GALLIUM FROM ALUMINATE SOLUTIONS

[75] Inventors: Colin George Honey, Hazlemore; Stanley Leonard Jones, Gerrards Cross, both of England

[73] Assignee: The British Aluminium Company Limited, London, England

[22] Filed: July 19, 1974

[21] Appl. No.: 490,034

[30] Foreign Application Priority Data

July 19, 1973 United Kingdom ..... 34480/73

[52] U.S. Cl. ..... 204/123; 204/105 R; 204/130

[51] Int. Cl.[2] ..... C25C 1/22

[58] Field of Search ..... 204/105 R, 123, 130

[56] References Cited

UNITED STATES PATENTS 3,677,918 7/1972 Miyake et al. ..... 204/105 R

*Primary Examiner*—R. L. Andrews

*Attorney, Agent, or Firm*—Karl W. Flocks

[57] ABSTRACT

A method of recovering gallium from sodium aluminate solutions comprises extracting gallium from aluminate solution by electrolysing the solution with a current density of at least 0.002 A/cm$^2$ and a cathodic potential relative to a saturated calomel electrode of at least 1.5 volts, using an anode made from a metal which does not produce undesirable impurities in the aluminate liquor under the conditions of electrolysis and a solid cathode made of a metal into which gallium diffuses, while maintaining the temperature of the aluminate solution in the range 25°to 80°C until the gallium has diffused into the cathode to give a gallium content in the surface layers of at least 0.10%. The cathode metal is preferably tin, lead, indium, zinc and alloys of tin and lead. The preferred current density range is 0.005 to 0.05 A/cm$^2$ while the preferred temperature range is 35°to 65°C. The gallium is subsequently separated from the cathode metal.

10 Claims, No Drawings

METHOD OF ELECTROLYTICALLY EXTRACTING GALLIUM FROM ALUMINATE SOLUTIONS

The recovery of metallic gallium from the sodium aluminate solutions found in the Bayer Process or any other process for the recovery of alumina from aluminium ores, hereafter referred to as aluminate liquor, by electrolysis of the liquor using conventional solid electrodes such as stainless steel or nickel is very difficult. The difficulty arises because of the low gallium concentrations (0.15 – 0.40 g/l) found in aluminate liquor and the presence of impurities such as iron, vanadium, chromium and organic materials which are often present in higher concentrations than the gallium and which interfere with the electrolytic deposition of gallium.

The procedures at present practiced for the recovery of gallium from aluminate liquors involve either: (1) partial or complete destruction of the sodium aluminate content of the liquor by either the two stage addition of carbon dioxide to first precipitate part of the alumina and then to co-precipitate the remainder of the alumina and the gallium (as gallium hydroxide) (French Pat. Specifications Nos. 952,976 and 969,033) or, by the addition of calcium oxide to precipitate part of the alumina as a mixture of calcium aluminates, followed by the addition of carbon dioxide (U.S. Pat. No. 2,582,376). Both methods form a gallium rich alumina from which gallium may be recovered by dissolution in sodium hydroxide followed by electrolysis: or, (2) electrolysis of aluminate liquor using a stirred mercury cathode into which the gallium is dispersed after deposition on the mercury surface (British Pat. Specifications Nos. 797,501 and 797,502).

The use of carbon dioxide or calcium oxide to form a gallium rich alumina destroys the aluminate liquor so that it cannot be reintroduced into the process without further treatment. The use of a stirred mercury cathode requires the handling of large quantities of mercury which is considered harzardous. Also, as rather strong stirring of the mercury is necessary there is a risk that fine droplets will be formed and dispersed into the aluminate liquor, this risk increases as the gallium content of the mercury increases and it is necessary to remove the mercury when it contains only 1% gallium.

SUMMARY OF THE INVENTION

An object of the present invention is to provide a method of extracting gallium which does not require pretreatment or contamination of the aluminate liquor.

The present invention provides a method of extracting gallium from aluminate liquor obtained in the course of the recovery of aluminium from aluminate ores which comprises electrolysing the solution with a current density of at least 0.002 A/cm$^2$ using a solid cathode made of a metal into which gallium diffuses until the gallium has diffused into the cathode to give a gallium content in the surface layers of at least 0.10%.

In this specification all percentages are by weight.

With advantage electrolysis is continued until the gallium content is at least 0.5% to a depth of at least 5 $\mu$m. The preferred cathode metals are tin, lead, indium, zinc and tin/lead alloys.

This process enables gallium to be extracted directly from aluminate liquors by its absorption into a solid metal cathode in an electrolytic process without substantially destroying or altering the sodium aluminate content of the liquors. In the operation of the process gallium is deposited on the cathode surface and diffuses into the metallic lattice of the cathode and is thus prevented from redissolving. When an appropriate concentration of gallium has accumulated in the cathode, the cathode may be withdrawn from the liquor and the gallium separated from the cathodic material by physical and/or chemical means. A preferred method of separating gallium from tin, lead or tin-lead alloy cathodes is described hereafter.

In the case of tin it is possible to obtain a gallium content in the cathode of over 4% by this method. The diffusion will result in a variation in the gallium content between the surface and the centre of the electrode and the most economic level at which to withdraw the cathode will depend upon such factors as the reduction in the rate of absorption with time resulting from a build up of gallium in the surface layers. The economic level of gallium in the cathode will also be dependent upon the ease of extraction of the gallium from the electrode. The cathode may be constructed in one of several manners. It may be in the form of a thin sheet such as a foil with a thickness of 0.01 to 0.3 mm. It may be a thicker block from which the surface layer is removed physically or chemically when a predetermined gallium content has built up in the surface layer. It may also be in the form of a thin coating of say 1 – 50 $\mu$m thickness on an inert substrate such as stainless steel. Each of these constructions allows an easier separation of gallium from the cathode material by maximising the gallium content. Also, by adopting one of these constructions it is possible to minimise the electrolysis time required to accumulate an economic gallium content in the cathode material.

The other metallic impurities e.g. iron, vanadium, chromium, in aluminate liquors which hinder or prevent the deposition of gallium onto conventional metallic cathodes are also deposited on the cathodes used in this process but we have found they do not prevent the deposition of gallium. They form initially as a hard film but are gradually displaced as the gallium builds up in the cathode.

One or more anodes are used and should be made from a metal that is insoluble under the conditions of electrolysis, or from a metal that if soluble under these conditions does not produce undesirable impurities in the aluminate liquor.

Platinum, platinum coated titanium, polished nickel or stainless steel anodes are equally effective in the recovery of gallium; pure aluminium may also be used as when this dissolves it does not contaminate the aluminate liquor or prevent the deposition of gallium at the cathode. The preferred arrangement is a nickel anode with a tin/lead cathode.

The current density of the cathode should be at least 0.002 amps/cm$^2$ and preferably between 0.005 and 0.05 amps/cm$^2$. The cathodic potential should be at least 1.5 volts relative to the saturated calomel electrode and preferably 1.65 to 2.10 volts. The terminal potential should be above 2.5 volts but in normal operation it is adjusted so as to obtain the required values for the cathodic potential and current density. The temperature of the electrolyte should be between 25°C and 80°C and preferably between 35°C and 65°C. At temperatures above 80°C gallium recovery is negligible. The use of higher cathodic current densities produces a substantially less than pro rata increase in the rate of gallium recovery and thus reduces the current efficiency, also, the use of higher current densities is accompanied by unacceptable foam formation and heating of the electrolyte.

The process may be applied to the aluminate liquors found at any stage in the usual processes for the recovery of alumina but preferably when the gallium content is at least 0.20 g/l. The process may be applied batchwise wherein a particular volume of aluminate liquor is electrolysed for a period sufficient to deposit the required amount of gallium in the cathode or, in a continuous process with a flow of untreated aluminate liquor past the electrodes wherein the cathodes are replaced when they have attained a predetermined gallium content.

EXAMPLES OF PREFERRED EMBODIMENTS

EXAMPLE 1

0.192 litre of aluminate liquor containing 320 g/l $Na_2O$, 160 g/l $Al_2O_3$ and 0.35 g/l Ga from a plant operating the Bayer Process for the recovery of alumina from bauxite was placed in a polythene vessel of 0.25 litre capacity. The liquor was maintained at 41°C and electrolysed by means of a vertically suspended tin cathode, which was 0.3 mm thick and of 50 $cm^2$ surface area, and a vertically suspended platinum coated titanium anode of 50 $cm^2$ surface area. Electrolysis was carried out for 2 hours with a cathode current density of 0.02 $A/cm^2$ which was achieved by adjusting the terminal voltage to 3.9 volts. At the end of 2 hours the electrolyte was diluted and warmed to redissolve any suspended or precipitated solids. This clear solution was then analysed and found to contain 0.235 g/l gallium which is equivalent to a 33% removal of gallium from the aluminate liquor. A horizontal cross section of the tin cathode was examined by electron microprobe, an instrument that allows analysis of microvolumes of a solid in situ and measures the distribution of a chemical element within the solid. It was found that gallium had penetrated up to 60 $\mu m$ into the tin perpendicular to each face of the cathode and, within this area there was a layer, 30 $\mu m$ thick, adjacent the surface, that had a concentration of 1.4% Ga which approximates to the amount removed from solution. There were no visible particles of gallium on the electrode surface and no deposits of gallium in the solution beneath the cathode.

EXAMPLE 2

An experiment was carried out under the same conditions described in Example 1 but with an electrolysis time of 20 hours. Analysis of the contents of the electrolytic cell revealed that the gallium content of the electrolyte had fallen to 0.105 g/l which is equivalent to a gallium removal of 70%.

Examination of a horizontal cross section of the tin cathode revealed that gallium had penetrated to a depth of up to 100 $\mu m$, and, there was a layer 60 $\mu m$ thick adjacent the surface that had a gallium content of 2.5%.

EXAMPLE 3

1.5 liters of aluminate liquor containing 155 g/l $Na_2O$, 75 g/l $Al_2O_3$ and 0.2 g/l Ga from a plant operating the Bayer Process for the recovery of alumina from bauxite was placed in a polythene vessel of two litres capacity. The liquor was maintained at 44°C and electrolysed by means of a vertically suspended indium cathode of 600 $cm^2$ surface area and a vertically suspended stainless steel anode of 50 $cm^2$ surface area. The current density at the cathode was 0.02 $A/cm^2$. After four hours electrolysis analysis of the electrolyte treated as in Example 1 showed 47.5% of the gallium had been removed.

EXAMPLE 4

0.195 liter of aluminate liquor from the same batch as described in Example 1 was placed in a polythene beaker of 0.25 liter capacity. The liquor was maintained at 42°C and electrolysed by means of a vertically suspended lead cathode constructed of thin lead sheet and a polished nickel anode, each electrode had a submerged area of 50 $cm^2$. The current density at the cathode was 0.02 $A/cm^2$ and the cathodic potential 1.8 – 1.9 volts relative to the saturated calomel electrode. Electrolysis was continued for 4 hours and subsequent chemical analysis of the lead cathode showed it to contain 0.28% gallium which is equivalent to 16% recovery of gallium from the liquor.

EXAMPLE 5

The experiment of Example 4 was repeated using a cathode manufactured from thin zinc sheet. Chemical analysis of the zinc cathode after 4 hours electrolysis showed it to contain 0.15% gallium which is equivalent to 14% gallium recovery from the aluminate solution.

EXAMPLE 6

0.201 liter of aluminate liquor containing 288 g/l $Na_2O$, 144 g/l $Al_2O_3$ and 0.31 g/l Ga from a plant operating the Bayer Process was placed in a polythene beaker of 0.25 liter capacity. The liquor was maintained at 53°C and electrolysed by means of a vertically suspended cathode of 50 $cm^2$ submerged area constructed from 0.1 mm thick, 60% Sn/40% Pb sheet, and a polished nickel anode of similar area. Electrolysis was continued for 4 hours with a cathode current density of 0.012 $A/cm^2$ and potential of 1.8 – 1.9 volts. Subsequent chemical analysis of the cathode showed it to contain 2.21% gallium which is equivalent to a recovery of 57% of the gallium from the aluminate solution.

EXAMPLE 7

4 liters of aluminate liquor containing 272 g/l $Na_2O$, 136 g/l $Al_2O_3$ and 0.30 g/l Ga were placed in a rectangular polypropylene vessel of approximate dimensions 30 × 12.5 × 18 cm, the depth of liquor was about 10.6 cm. The liquor was heated to 50°C and electrolysed by means of seven vertically hanging polished nickel anodes interspaced by six vertically hanging tin cathodes constructed from 0.05 mm tin sheet, the submerged dimension of the anodes and the cathodes were 11 × 91/2 cm. Electrolysis was continued for 4 hours at a cathodic current density of 0.013 $A/cm^2$ with a cathodic potential of 1.8 – 1.9 volts. Chemical analysis of the tin cathodes after electrolysis showed them to contain 3.4% gallium which represents a 64% recovery of gallium from the aluminate liquor.

We claim:

1. A method of extracting gallium from aluminate liquor obtained in the course of the recovery of aluminate from aluminate ores which comprises electrolysing the liquor with a current density of at least 0.002 $A/cm^2$ and a cathodic potential relative to a saturated calomel electrode of at least 1.5 volts, using an anode made from a metal which does not produce undesirable impurities in the aluminate liquor under the conditions of electrolysis and a solid cathode made of a metal into which gallium diffuses, while maintaining the temperature of the aluminate solution in the range 25°to 80°C until the gallium has diffused into the cathode to give a gallium content in the surface layers of at least 0.10%.

2. A method according to claim 1, in which electrolysis is continued until the gallium content in the surface layers to a depth of at least 5 $\mu$m is at least 0.5%.

3. A method according to claim 1, in which the metal of the cathode is selected from the group consisting of tin, lead, indium, zinc, or tin/lead alloys.

4. A method according to claim 1, in which the anode is selected from the group consisting of platinum, platinum coated titanium, polished nickel, stainless steel and aluminium.

5. A method according to claim 1, which comprises maintaining the current density in the range 0.005 to 0.05 A/cm$^2$.

6. A method according to claim 1, which includes maintaining said cathodic potential in the range 1.65 to 2.10 volts.

7. A method according to claim 1, which includes maintaining said temperature in the range 35° to 65°C.

8. A method according to claim 1 in which the initial concentration of gallium in the aluminate liquor is greater than 0.20 g/l.

9. A method according to claim 1, which includes subsequently separating the gallium from the cathode metal.

10. In a method of extracting gallium from aluminate liquor obtained in the course of the recovery of aluminate from aluminate ores and wherein said aluminate liquor contains vanadium as an impurity, comprising electrolyzing the liquor to deposit gallium on the cathode, the improvement comprising:

using a current density in the range of 0.005 to 0.05 A/cm$^2$;

using a cathodic potential relative to the saturated calomel electrode in the range of 1.65 to 2.10 volts;

using an anode made from a metal which does not produce undesirable impurities in the aluminate liquor under the conditions of electrolysis;

using a solid cathode made of a metal into which gallium diffuses selected from the group consisting of tin, lead, indium, zinc, and tin/lead alloys; and maintaining the temperature of the aluminate solution in the range of 35°–65°C until the gallium has diffused into the cathode to give a gallium content in the surface layers of at least 0.10%.

* * * * *